US010309393B2

(12) United States Patent
Nakaoka

(10) Patent No.: US 10,309,393 B2
(45) Date of Patent: Jun. 4, 2019

(54) HIGH-PRESSURE PUMP AND PRODUCTION METHOD THEREOF

(71) Applicant: DENSO CORPORATION, Kariya, Aichi-pref. (JP)

(72) Inventor: Masaharu Nakaoka, Kariya (JP)

(73) Assignee: DENSO CORPORATION, Kariya (JP)

( * ) Notice: Subject to any disclaimer, the term of this patent is extended or adjusted under 35 U.S.C. 154(b) by 47 days.

(21) Appl. No.: 15/543,778

(22) PCT Filed: Dec. 22, 2015

(86) PCT No.: PCT/JP2015/006377
§ 371 (c)(1),
(2) Date: Jul. 14, 2017

(87) PCT Pub. No.: WO2016/116994
PCT Pub. Date: Jul. 28, 2016

(65) Prior Publication Data

US 2018/0010602 A1 Jan. 11, 2018

(30) Foreign Application Priority Data

Jan. 20, 2015 (JP) ..... 2015-008335

(51) Int. Cl.
*F04B 53/22* (2006.01)
*F04B 53/16* (2006.01)
(Continued)

(52) U.S. Cl.
CPC ..... *F04B 53/16* (2013.01); *F02M 59/26* (2013.01); *F02M 59/44* (2013.01);
(Continued)

(58) Field of Classification Search
CPC ..... F04B 53/22; F02M 59/445; F02M 59/48
See application file for complete search history.

(56) References Cited

U.S. PATENT DOCUMENTS

2012/0195779 A1 8/2012 Hishinuma et al.
2017/0009721 A1* 1/2017 Albrecht ..... F02M 55/007

FOREIGN PATENT DOCUMENTS

JP 2001-304069 10/2001
JP 2001-355542 12/2001
(Continued)

OTHER PUBLICATIONS

International Search Report for PCT/JP2015/006377, dated Apr. 5, 2016, 4 pages.
(Continued)

*Primary Examiner* — F Daniel Lopez
(74) *Attorney, Agent, or Firm* — Nixon & Vanderhye P.C.

(57) ABSTRACT

A pump body of a high-pressure pump includes a pressure chamber formed in a deep portion of a cylinder. The pump body closes the pressure chamber on a side opposite to a plunger. The plunger reciprocates within the cylinder to vary a volume of the pressure chamber. The large-diameter portion provided at an end of the plunger on a side protruding to the pressure chamber has an outside diameter larger than an inside diameter of the cylinder and smaller than an inside diameter of the pressure chamber. In this case, the large-diameter portion is engaged with a step portion between the cylinder and the pressure chamber in a state before attachment of the high-pressure pump to an internal combustion engine. Accordingly, separation of the plunger from the cylinder is avoidable.

9 Claims, 10 Drawing Sheets

(51) Int. Cl.

| | |
|---|---|
| ***F02M 59/26*** | (2006.01) |
| ***F02M 59/44*** | (2006.01) |
| ***F04B 53/14*** | (2006.01) |
| ***F04B 1/04*** | (2006.01) |
| ***F04B 1/053*** | (2006.01) |
| ***F02M 59/48*** | (2006.01) |
| ***F04B 7/00*** | (2006.01) |
| ***F04B 11/00*** | (2006.01) |
| *B21D 31/04* | (2006.01) |
| *B21D 39/04* | (2006.01) |
| *F04B 19/22* | (2006.01) |

(52) U.S. Cl.

CPC ..... *F02M 59/445* (2013.01); *F02M 59/48* (2013.01); *F04B 1/0408* (2013.01); *F04B 1/0413* (2013.01); *F04B 1/0421* (2013.01); *F04B 1/053* (2013.01); *F04B 7/0076* (2013.01); *F04B 11/00* (2013.01); *F04B 53/14* (2013.01); *F04B 53/162* (2013.01); *B21D 31/04* (2013.01); *B21D 39/04* (2013.01); *F04B 19/22* (2013.01); *F04B 53/22* (2013.01)

(56) References Cited

FOREIGN PATENT DOCUMENTS

| | | |
|---|---|---|
| JP | 2003-65175 | 3/2003 |
| WO | WO 2016/116995 | 7/2016 |

OTHER PUBLICATIONS

Nakaoka, U.S. Appl. No. 15/543,756, filed Jul. 14, 2017 (38 pages).

* cited by examiner

HIGH-PRESSURE PUMP AND PRODUCTION METHOD THEREOF

CROSS-REFERENCE TO RELATED APPLICATION

This application is the U.S. national phase of International Application No. PCT/JP2015/006377 filed Dec. 22, 2015, which designated the U.S. and claims priority to Japanese Patent Application No. 2015-8335 filed on Jan. 20, 2015, the entire contents of each of which are hereby incorporated herein by reference.

TECHNICAL FIELD

The present disclosure relates to a high-pressure pump for an internal combustion engine, and to a production method of the high-pressure pump.

BACKGROUND ART

A high-pressure pump provided in a fuel supply system has been known. The high-pressure pump pressurizes fuel in the system to supply the pressurized fuel to an internal combustion engine.

The high-pressure pump pressurizes the fuel by varying a volume of a pressure chamber formed in a deep portion of a cylinder in accordance with reciprocating movement of a plunger provided inside the cylinder. The fuel pressurized by the pressure chamber is discharged from a discharge path communicating with the pressure chamber.

According to an example of a high-pressure pump described in Patent Literature 1, a ring-shaped member fits to a radially outer portion of a plunger on the side exposed to a pressure chamber. This high-pressure pump prevents separation of the plunger from a cylinder by engagement between the ring-shaped member and a step portion formed between the pressure chamber and the cylinder in a state before attachment to an internal combustion engine.

According to another example of the high-pressure pump described in Patent Literature 1, the outside diameter of the plunger at a portion protruding from the cylinder toward the side opposite to the pressure chamber is smaller than the outside diameter of the plunger at a portion inside the cylinder. The plunger therefore has a step at the portion corresponding to the change of the outside diameter of the plunger. This high-pressure pump similarly prevents separation of the plunger from the cylinder by engagement between the step of the plunger and a step portion of a pump body in a state before attachment to an internal combustion engine.

According to the high-pressure pump described in Patent Literature 1, a suction valve unit that controls supply of fuel to the pressure chamber is provided on the pressure chamber on the side opposite to the plunger. The suction valve unit is detachably attached to the pump body. This configuration of the high-pressure pump allows insertion of the plunger from the pressure chamber into the cylinder before assembly of the suction unit to the pump body.

According to the high-pressure pump described in Patent Literature 1, however, the size of the high-pressure pump in the axial direction of the cylinder increases by the presence of the suction valve unit described above. When the position of the suction valve unit of the high-pressure pump described in Patent Literature 1 is switched to a position in the radial direction of the cylinder, and the pressure chamber on the side opposite to the plunger is closed by the pump body, for example, assembly of the plunger to the cylinder from an opening of the cylinder on the side opposite to the pressure chamber is difficult in any of the examples described above.

PRIOR ART LITERATURE

Patent Literature

PATENT LITERATURE 1: JP 2003-65175 A

SUMMARY OF INVENTION

It is an object of the present disclosure to provide a high-pressure pump capable of preventing separation of a plunger regardless of an assembly direction of the plunger to a cylinder, and to provide a production method of this high-pressure pump.

A high-pressure pump includes a cylinder, a pump body, a plunger, and a large-diameter portion.

The pump body includes a pressure chamber having an inside diameter larger than an inside diameter of the cylinder, and disposed in a deep portion of the cylinder. The pump body closes the pressure chamber on a side opposite to the plunger. The plunger reciprocates within the cylinder to vary a volume of the pressure chamber. The large-diameter portion provided at an end of the plunger on a side protruding to the pressure chamber has an outside diameter larger than the inside diameter of the cylinder and smaller than the inside diameter of the pressure chamber.

According to this structure, the large-diameter portion is engaged with a step portion between the cylinder and the pressure chamber in a state before attachment of the high-pressure pump to an internal combustion engine. Accordingly, separation of the plunger from the cylinder can be prevented.

A production method of a high-pressure pump includes a temperature control process and an insertion process. In the temperature control process, at least either "heating the cylinder" or "cooling the large-diameter portion" is performed to allow the inside diameter of the cylinder to become larger than the outside diameter of the large-diameter portion. The insertion process inserts the plunger into the cylinder.

Accordingly, the large-diameter portion provided at the end of the plunger is insertable into the pressure chamber even when the high-pressure pump is configured such that the pressure chamber on the side opposite to the plunger is closed by the pump body.

BRIEF DESCRIPTION OF DRAWINGS

The above and other objects, features, and advantages of the present disclosure will become more apparent from the following detailed description made with reference to the accompanying drawings.

EMBODIMENTS FOR CARRYING OUT INVENTION

A plurality of embodiments according to the present disclosure are hereinafter described with reference to the drawings. Note that substantially identical configurations in the plurality of embodiments have been given identical reference numbers. The same explanation is not repeated for the identical configurations.

First Embodiment

A first embodiment of the present disclosure is hereinafter described with reference to FIGS. 1 to 6. A high-pressure pump 1 according to the present embodiment is attached to an engine block 2 of an internal combustion engine, pressurizes fuel drawn from a fuel tank, and pumps the fuel to a delivery pipe. The fuel accumulated in the delivery pipe is injected and supplied from an injector to respective cylinders of the internal combustion engine.

Figure 1:
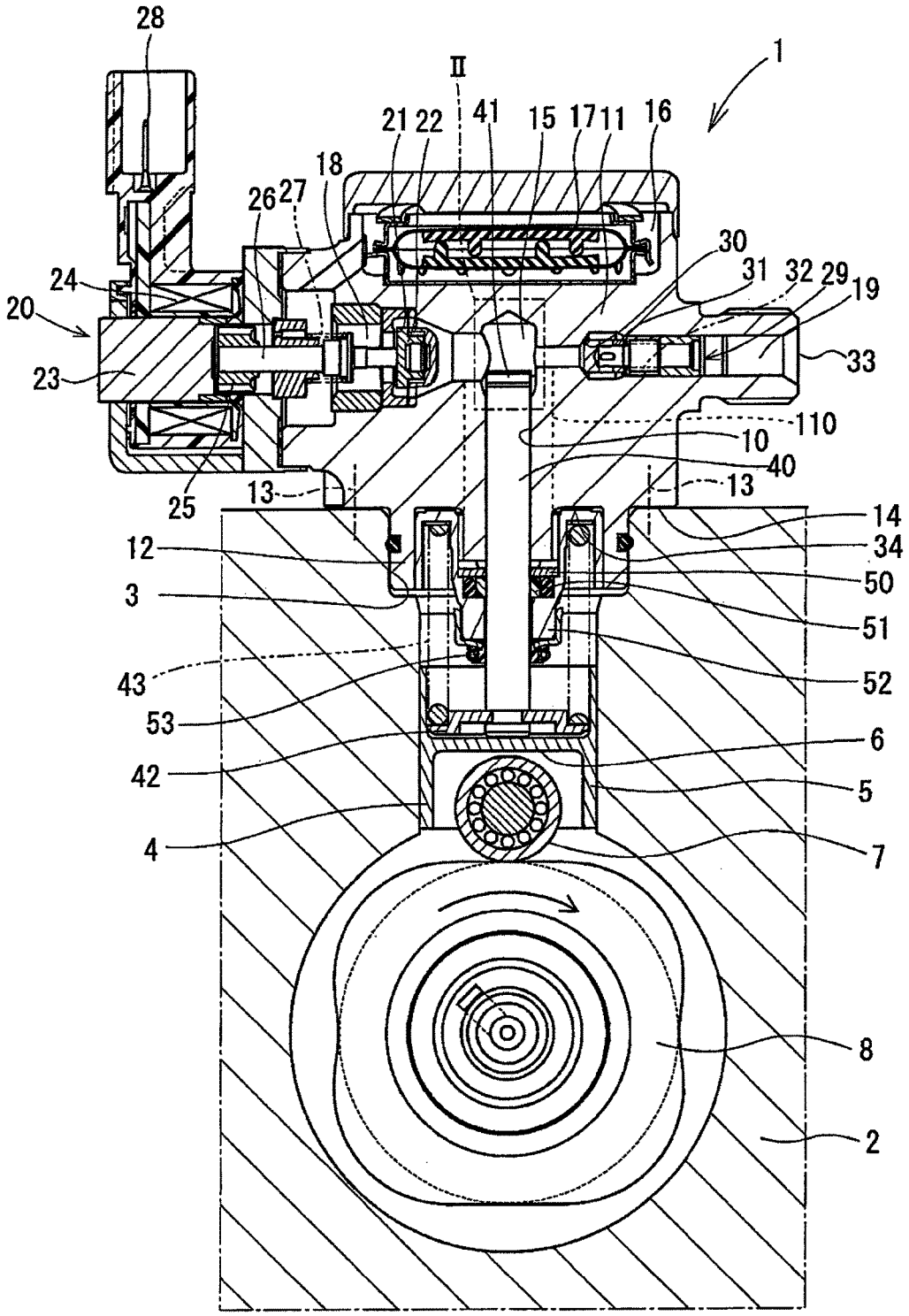
FIG. 1 is a cross-sectional view of a high-pressure pump according to a first embodiment of the present disclosure.

The high-pressure pump 1 includes a cylinder 10, a pump body 11, a plunger 40, a large-diameter portion 41, and others as illustrated in FIG. 1.

In FIG. 1, a conceptual boundary between the cylinder 10 and the pump body 11 is indicated by a broken line 110. However, the cylinder 10 and the pump body 11 in the present embodiment are formed integrally.

The pump body 11 includes a fitting portion 12 having a cylindrical shape and capable of fitting to a bore 3 formed in the engine block 2 of the internal combustion engine. The pump body 11 is fixed to the engine block 2 by a bolt (not shown) provided at a position indicated by a chain line 13 in FIG. 1. In this condition, a contact surface 14 provided outside the fitting portion 12 contacts the engine block 2.

The pump body 11 includes a pressure chamber 15 formed in a deep portion the cylinder 10. The pressure chamber 15 on the side opposite to the plunger 40 is closed by the pump body 11.

Figure 2:
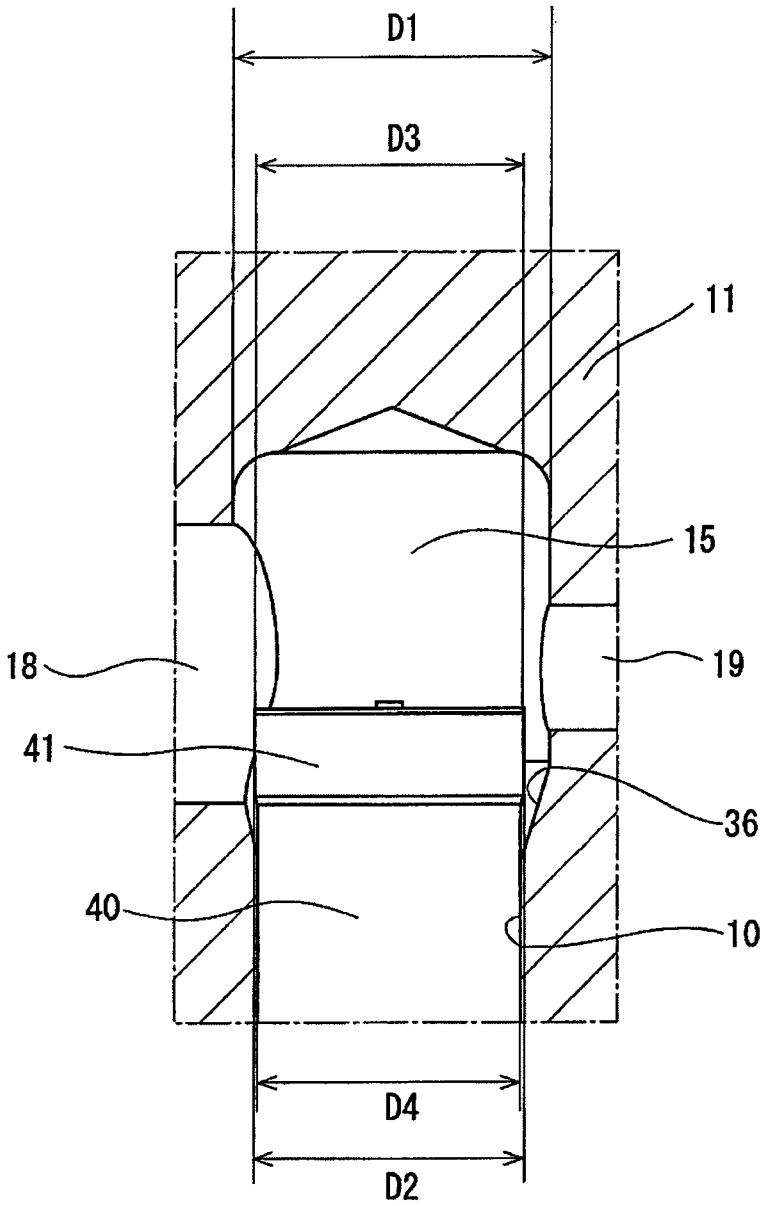
FIG. 2 is an enlarged view of a part II in FIG. 1.
Figure 3:
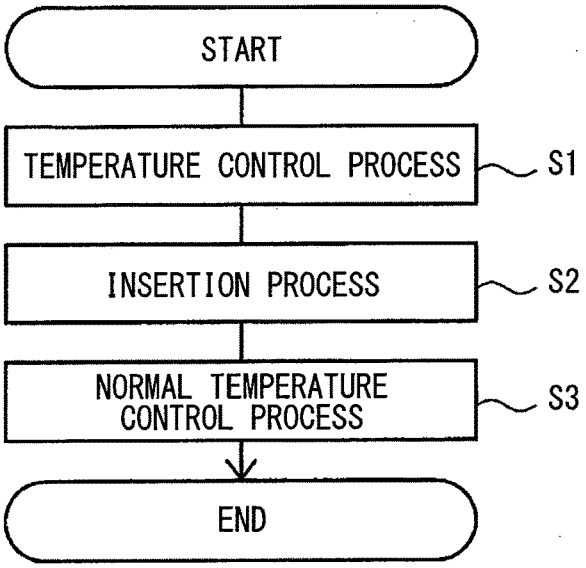
FIG. 3 is a flowchart showing a production process of the high-pressure pump according to the first embodiment.

As illustrated in FIG. 2, an inside diameter D1 of the pressure chamber 15 is slightly larger than an inside diameter D2 of the cylinder 10. Accordingly, a step portion 36 having a tapered-shape is formed at a connection portion between the pressure chamber 15 and an inner wall of the cylinder 10.

The plunger 40 is accommodated inside the cylinder 10 formed into a cylindrical shape so as to reciprocate in the axial direction. The plunger 40 moves toward the damper chamber 16 to decrease the volume of the pressure chamber 15 and pressurize fuel. The plunger 40 also moves toward the side opposite to the damper chamber 16 to increase the volume of the pressure chamber 15 and suction the fuel from a supply path 18 into the pressure chamber 15.

The large-diameter portion 41 is provided at an end of the plunger 40 on the side protruding to the pressure chamber 15. According to the present embodiment, the large-diameter portion 41 and the plunger 40 are formed integrally.

An outside diameter D3 of the large-diameter portion 41 is slightly larger than an outside diameter D4 of the plunger 40 at normal temperature. In addition, the outside diameter D3 of the large-diameter portion 41 is larger than the inside diameter D2 of the cylinder 10, and smaller than the inside diameter D1 of the pressure chamber 15.

Accordingly, a relationship D1>D3>D2>D4 holds between the inside diameter D1 of the pressure chamber 15, the inside diameter D2 of the cylinder 10, the outside diameter D3 of the large-diameter portion 41, and the outside diameter D4 of the plunger 40 at a normal temperature. A difference between the outside diameter D3 of the large-diameter portion 41 and the inside diameter D2 of the cylinder 10 (D3−D2) is set around several micrometers.

A relationship between the large-diameter portion 41 and the cylinder 10 in the present invention is hereinafter described.

The relationship between the inside diameter D1 of the pressure chamber 15, the inside diameter D2 of the cylinder 10, the outside diameter D3 of the large-diameter portion 41, and the outside diameter D4 of the plunger 40 according to the present embodiment switches to D1>D2>D3>D4 when any of following operations (A), (B), and (C) is performed. (A) The pump body 11 and the cylinder 10 are heated, while the large-diameter portion 41 and the plunger 40 are cooled. (B) The pump body 11 and the cylinder 10 are heated. (C) The large-diameter portion 41 and the plunger 40 are cooled.

In this case, the difference between the outside diameter D3 of the large-diameter portion 41 and the inside diameter D2 of the cylinder 10 (D3−D2) is set to such a size as to realize the foregoing relationship. Accordingly, insertion of the large-diameter portion 41 into the pressure chamber 15 is allowed from an opening of the cylinder 10 on the side opposite to the pressure chamber 15.

After any one of the operations (A), (B), and (C) is completed, the temperatures of the cylinder 10 and the large-diameter portion 41 are returned to the temperatures before the operation. As a result, the relationship between the inside diameter D1 of the pressure chamber 15, the inside diameter D2 of the cylinder 10, the outside diameter D3 of the large-diameter portion 41, and the outside diameter D4 of the plunger 40 becomes D1>D3>D2>D4. The large diameter portion 41 is therefore engaged with the step portion 36 connecting the cylinder 10 and the pressure chamber 15 in a state before attachment of the high-pressure pump 1 to the inner combustion engine. Accordingly, prevention of separation of the plunger 40 from the cylinder 10, and retention of a compressed state of a plunger spring 43 described below are both achievable.

As illustrated in FIG. 1, a damper chamber 16 is formed in the pump body 11 on the pressure chamber 15 side opposite to the cylinder 10 side. The damper chamber 16 includes a pulsation damper 17. The pulsation damper 17 contains gas having a predetermined pressure and sealed between two metal diaphragms, and reduces fuel pressure pulsation of the damper chamber 16 by elastic deformation of the two metal diaphragms in accordance with a pressure change of the damper chamber 16.

The pump body 11 includes the supply path 18 and a discharge path 19 each of which extends in a radial direction of the cylinder 10 from the pressure chamber 15.

A suction valve unit 20 is provided in the supply path 18. The suction valve unit 20 connects or separates the pressure chamber 15 and the supply path 18 by separating or connecting a suction valve 22 from and to a valve seat 21 formed in the supply path 18. Driving of the suction valve 22 is controlled by an electromagnetic driving unit. The electromagnetic driving unit is configured by a fixed core 23, a coil 24, a movable core 25, a shaft 26, a spring 27, and others. The suction valve 22 in the present embodiment is a normally open type. When power is supplied from a connector terminal 28 to the coil 24, magnetic force thus generated attracts the movable core 25 toward the fixed core 23 while resisting urging force of the spring 27, thereby achieving cancellation of urging force of the shaft 26 urging the suction valve 22 in a valve opening direction.

A discharge valve unit 29 is provided in the discharge path 19. The discharge valve unit 29 connects or separates the pressure chamber 15 and the discharge path 19 by separating or connecting a discharge valve 31 from and to a valve seat 30 formed in the discharge path 19. The discharge valve 31 is separated from the valve seat 30 when force applied to the discharge valve 31 from fuel on the pressure chamber 15 side exceeds the sum of force applied to the discharge valve 31 from fuel on the downstream side of the valve seat 30 and elastic force of the spring 32. As a result, fuel in the pressure chamber 15 passes through the discharge path 19 to the outside from a fuel outlet 33.

A spring seat 42 is fixed to an end of the plunger 40 on the side opposite to the pressure chamber 15. The plunger spring 43 is provided between the spring seat 42 and a holder 52 fixed to the pump body 11. The plunger spring 43 and the spring seat 42 urge the plunger 40 to the side opposite to the pressure chamber 15. The spring seat 42 is fitted to a lifter 4 inserted into a bore 3 of the internal combustion engine.

The lifter 4 includes a cylindrical portion 5 having a cylindrical shape, a partitioning plate 6 disposed at an axially intermediate portion of the cylindrical portion 5, and a roller 7 disposed on the side opposite to the spring seat 42 with the partitioning plate 6 interposed between the spring seat 42 and the roller 7. An outer wall of the cylindrical portion 5 is in sliding contact with an inner wall of the bore 3 of the internal combustion engine. The roller 7 comes in sliding contact with a cam 8 provided in a deep portion of the bore 3 of the internal combustion engine. The cam 8 rotates with a cam shaft or a crank shaft provided to drive a suction valve or a discharge valve of the internal combustion engine. Rotation of the cam 8 reciprocates the lifter 4 inside the bore 3, thereby reciprocating the plunger 40 in the cylinder 10 in the axial direction by contact between the plunger 40 and the partitioning plate 6 of the lifter 4.

A spacer 50 having an annular shape is provided at an end of the cylinder 10 on the side opposite to the pressure chamber 15. A fuel seal 51 is provided on the spacer 50 on the side opposite to the pressure chamber 15. The fuel seal 51 regulates a thickness of a fuel film around the plunger 40 to reduce leak of fuel toward the internal combustion engine caused by sliding of the plunger 40.

A holder 52 is provided on the fuel seal 51 on the side opposite to the pressure chamber 15. The holder 52 is extended toward the pump body 11, and fixed to a recess portion 34 formed in the pump body 11 around the cylinder 10.

An oil seal 53 is attached to an end of the holder 52 on the side opposite to the pressure chamber 15. The oil seal 53 regulates a thickness of an oil film around the plunger 40 to reduce entrance of oil from the internal combustion engine caused by sliding of the plunger 40.

A production method of the high-pressure pump 1 is now described with reference to FIGS. 3 to 6.

In an initial temperature control process of 51, both "heating the pump body 11 and the cylinder 10", and "cooling the large-diameter portion 41 and the plunger 40" are performed. This process is continued until the relationship between the inside diameter D1 of the pressure chamber 15, the inside diameter D2 of the cylinder 10, the outside diameter D3 of the large-diameter portion 41, and the outside diameter D4 of the plunger 40 becomes D1>D2>D3>D4.

Note that the process performed in the temperature control process may be only either "heating the pump body 11 and the cylinder 10" or "cooling the large-diameter portion 41 and the plunger 40" as long as the foregoing relationship D1>D2>D3>D4 is realizable.

Figure 4:
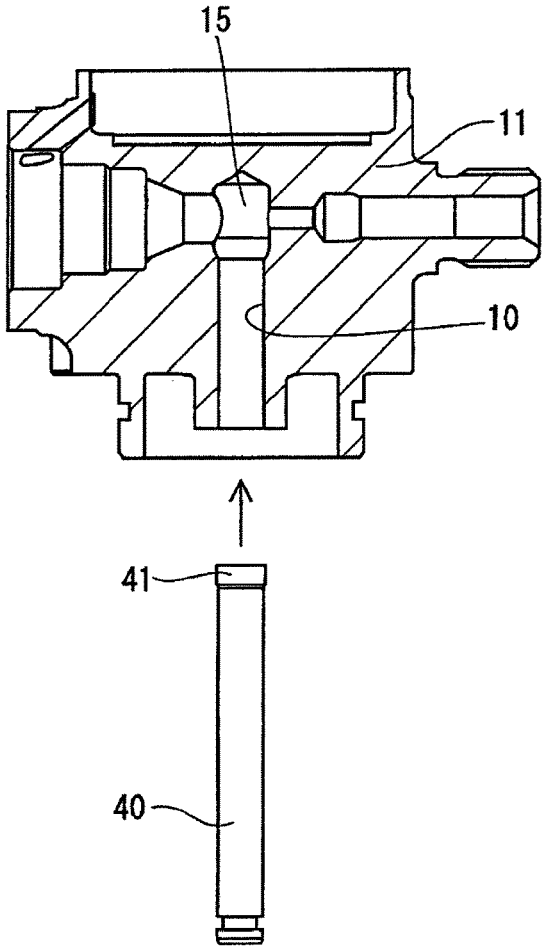
FIG. 4 is a cross-sectional view illustrating a state of the high-pressure pump during production.

In a subsequent insertion process of S2, the plunger 40 is inserted into the cylinder 10 as indicated by an arrow in FIG. 4. In this case, the large-diameter portion 41 passes through the inside of the cylinder 10, and comes into a state accommodated within the pressure chamber 15.

In a subsequent normal temperature control process of S3, the temperatures of the cylinder 10 and the large-diameter portion 41 approach the temperatures before the temperature control process. This process may be achieved by leaving the high-pressure pump 1 at normal temperature after insertion of the plunger 40 into the cylinder 10 and insertion of the large-diameter portion 41 into the pressure chamber 15. Alternatively, processes for cooling the cylinder 10, and heating the plunger 40 may be performed to return the temperature of the high-pressure pump 1 to normal temperature.

Figure 5:
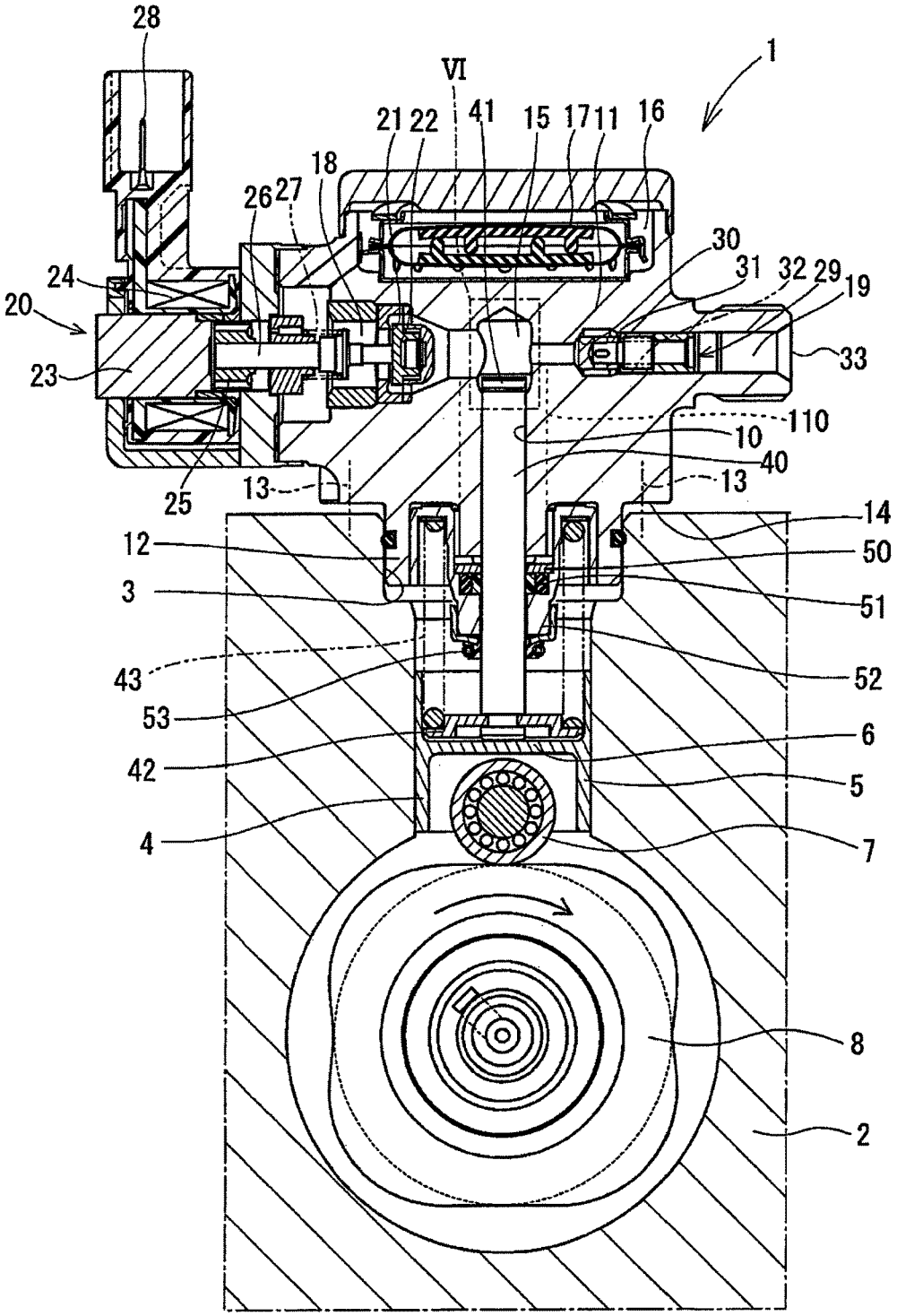
FIG. 5 is a partial cross-sectional view of the high-pressure pump in a state for attachment to an internal combustion engine.
Figure 6:
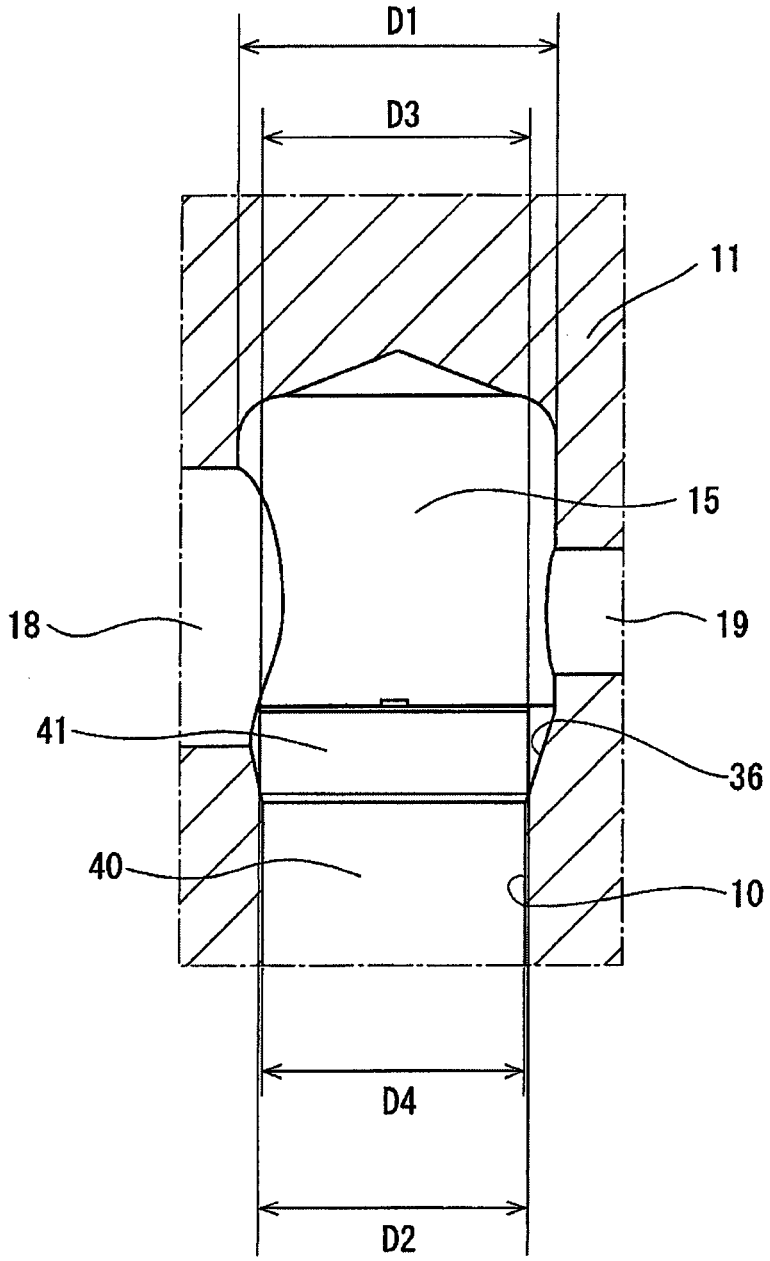
FIG. 6 is an enlarged view of a part VI in FIG. 5.

Thereafter, the high-pressure pump 1 is attached to the bore 3 formed in the engine block 2 of the internal combustion engine as illustrated in FIGS. 5 and 6. FIGS. 5 and 6 illustrate a state of the pump body 11 before fastened to the engine block 2 via a bolt 13. In this state, the large-diameter portion 41 is engaged with the step portion 36 between the pressure chamber 15 and the cylinder 10, whereby the plunger spring 43 is compressed by a predetermined amount. The fitting portion 12 of the pump body 11 is therefore fitted into the bore 3 of the engine block 2. In this case, the compression amount of the plunger spring 43 necessary for fastening by the bolt decreases. Accordingly, the pump body 11 is fastened to the engine block 2 by the bolt more easily.

Following advantageous effects are offered in the first embodiment.

(1) According to the high-pressure pump 1 of the first embodiment, the pump body 11 closes the pressure chamber 15 on the side opposite to the plunger 40. The large-diameter portion 41 is provided at the end of the plunger 40 on the side protruding to the pressure chamber 15. The large-diameter portion 41 has the outside diameter larger than the inside diameter of the cylinder 10 and smaller than the inside diameter of the pressure chamber 15.

In this case, the large-diameter portion 41 is engaged with the step portion 36 between the cylinder 10 and the pressure chamber 15 in a state before attachment of the high-pressure pump 1 to the internal combustion engine. Accordingly, separation of the plunger 40 from the cylinder 10 is avoidable. Assembly to the pump body 11 is therefore allowed in a state that the plunger spring 43 is compressed by a predetermined amount according to the high-pressure pump 1. In this case, the compression length of the plunger spring 43 necessary for fastening the high-pressure pump 1 to the internal combustion engine by the bolt decreases, and therefore work efficiency increases.

In addition, the pump body 11 of the high-pressure pump 1 closes the pressure chamber 15 on the side opposite to the plunger 40. The suction valve unit 20 for supplying fuel to the pressure chamber 15 therefore is not located in the pressure chamber 15 on the side opposite to the plunger 40. Accordingly, the axial size of the cylinder 10 of the high-pressure pump 1 decreases.

(2) According to the high-pressure pump 1 of the first embodiment, the cylinder 10 and the pump body 11 are formed integrally. Moreover, the large-diameter portion 41 and the plunger 40 are formed integrally. When the high-pressure pump 1 performs at least either "heating the pump body 11 and the cylinder 10" or "cooling the large-diameter portion 41 and the plunger 40", the inside diameter of the cylinder 10 becomes larger than the outside diameter of the large-diameter portion 41.

Accordingly, the large-diameter portion 41 provided at the end of the plunger 40 is insertable into the pressure chamber 15 even when the high-pressure pump 1 is configured such that the pressure chamber 15 on the side opposite to the plunger 40 is closed by the pump body 11.

In addition, the number of parts of the high-pressure pump 1 decreases by forming the cylinder 10 and the pump body 11 integrally with each other. The number of parts of the high-pressure pump 1 similarly decreases by forming the large-diameter portion 41 and the plunger 40 integrally with each other.

(3) According to the production method of the high-pressure pump 1 of the first embodiment, at least either "heating the pump body 11 and the cylinder 10" or "cooling the large-diameter portion 41 and the plunger 40" is performed to allow the inside diameter of the cylinder 10 becomes larger than the outside diameter of the large-diameter portion 41 in the temperature control process.

Accordingly, the large-diameter portion 41 provided at the end of the plunger 40 is insertable into the pressure chamber 15 even when the high-pressure pump 1 is configured such that the pressure chamber 15 on the side opposite to the plunger 40 is closed by the pump body 11.

First Comparative Example

Figure 7:
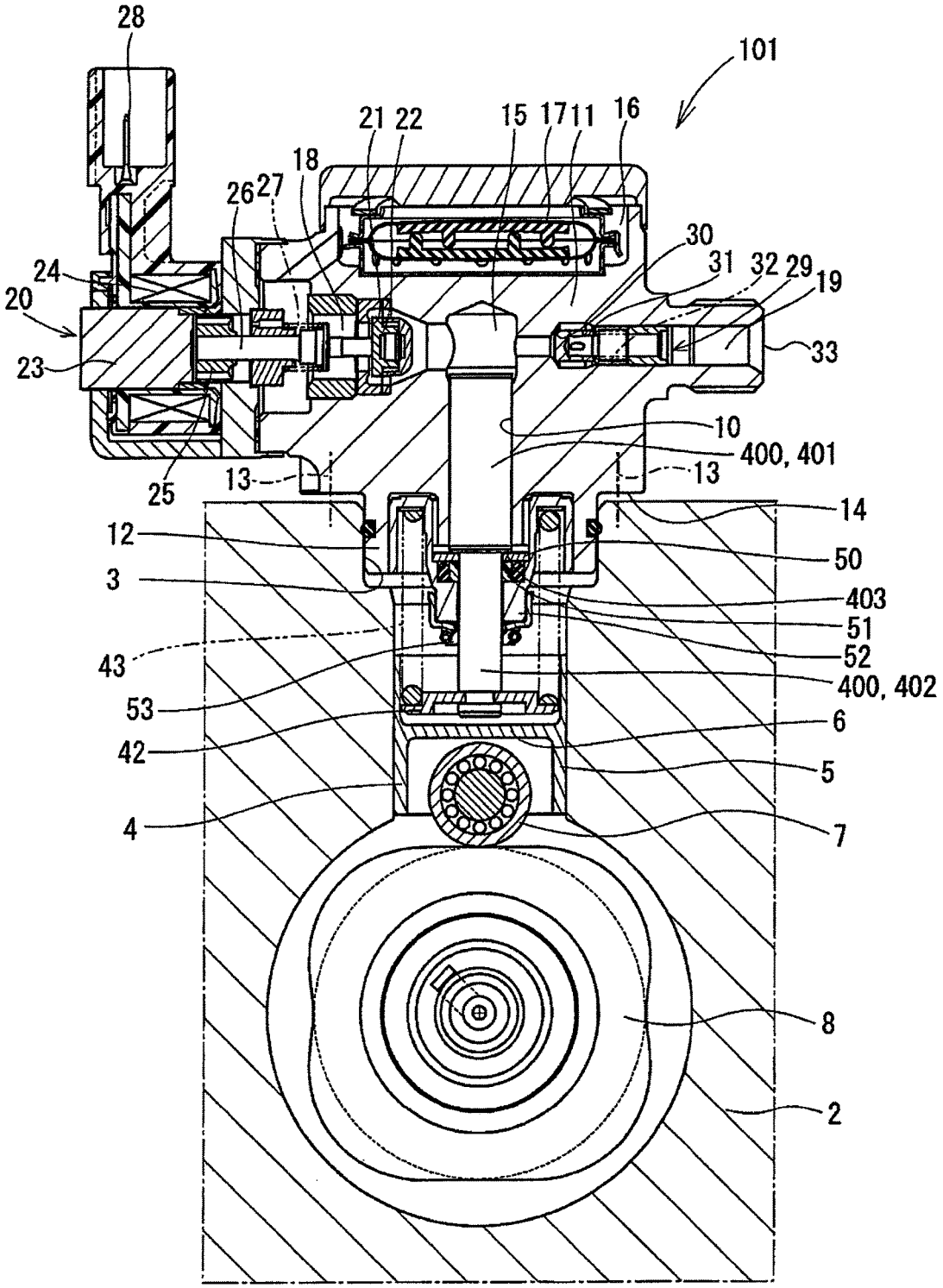
FIG. 7 is a cross-sectional view of a high-pressure pump of a first comparative example in a state for attachment to an internal combustion engine.

A first comparative example is described with reference to FIG. 7. A plunger 400 of a high-pressure pump 101 according to the first comparative example includes a large column portion 401 having a large diameter, and a small column portion 402 having an outside diameter smaller than an outside diameter of the large column portion 401. The large column portion 401 is inserted into the cylinder 10. The small column portion 402 protrudes to the side of the cylinder 10 opposite to the pressure chamber 15. The plunger 400 includes a step 403 at a connection portion between the large column portion 401 and the small column portion 402.

The spacer 50 having an annular shape and provided at the end of the cylinder 10 on the side opposite to the pressure chamber 15 has an inside diameter corresponding to an inside diameter of the small column portion 402 of the plunger 400. According to the high-pressure pump 101 of the first comparative example, therefore, the step 403 of the plunger 400 is engaged with the spacer 50 in a state before attached to the internal combustion engine. Accordingly, separation of the plunger 400 from the cylinder 10 is avoidable.

In general, the plunger 400 of the high-pressure pump 101 is pressed in a rotation direction of the cam 8 during reciprocation of the plunger 400 within the cylinder 10 by rotation of the cam 8. Accordingly, the plunger is inclined within the cylinder during reciprocation. The high-pressure pump 101 of the first comparative example includes the step 403 at the connection portion between the large column portion 401 and the small column portion 402, and a corner of the step comes into contact with the inner wall of the cylinder. In this case, reaction force acting on the contact portion increases in accordance with a rise of the plunger even when pressing force of the cam is constant. On the other hand, the plunger 40 according to the first embodiment contacts the inner wall of the cylinder at a corner of the cylinder end. In this case, reaction force acting on the contact portion decreases in accordance with a rise of the plunger when pressing force of the cam is constant. Accordingly, seize resistance of the plunger 400 included in the high-pressure pump 101 of the first comparison example may deteriorate in comparison with the plunger 40 of the first embodiment.

Second Comparison Example

Figure 8:
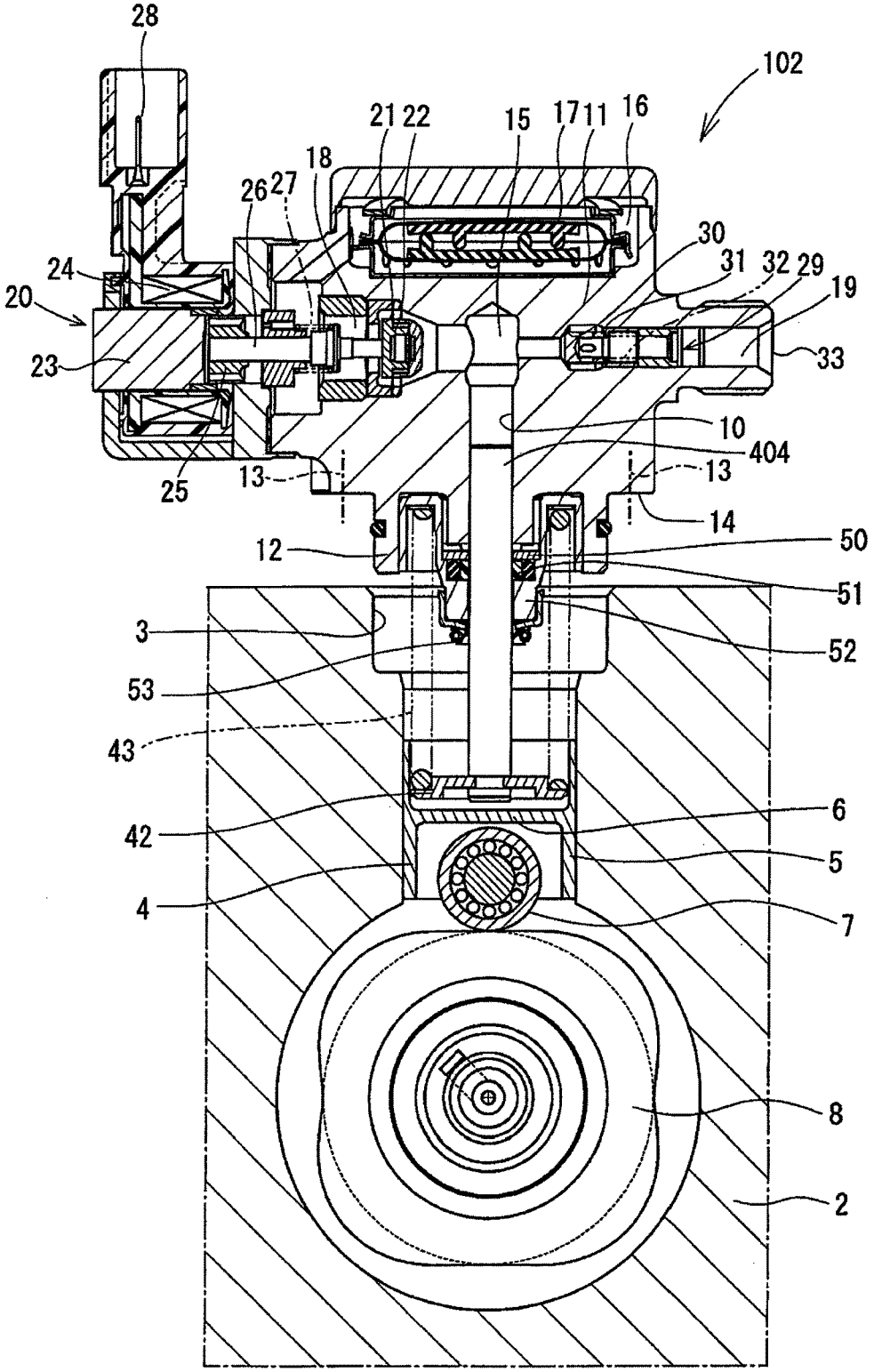
FIG. 8 is a cross-sectional view of a high-pressure pump of a second comparative example in a state for attachment to an internal combustion engine.

A second comparative example is now described with reference to FIG. 8. The plunger 40 of a high-pressure pump 102 according to the second comparative example is configured by a so-called straight plunger 404 having a constant outside diameter in the axial direction. However, the high-pressure pump 102 of the second comparative example does not have a configuration for preventing separation of the straight plunger 404. In this case, the plunger spring 43 extends to a free length at the time of attachment of the high-pressure pump 102 to the bore 3 of the internal combustion engine, and thus fastening of the pump body 11 by the bolt is initiated from a state that the fitting portion 12 of the pump body 11 is not fitted to the bore 3. The high-pressure pump 102 therefore simultaneously requires an operation for compressing the plunger spring 43 and fitting the fitting portion 12 of the pump body 11 into the bore 3, and an operation for fastening the pump body 11 to the engine block 2 by the bolt. Accordingly, work efficiency may deteriorate.

Second Embodiment

Figure 9:
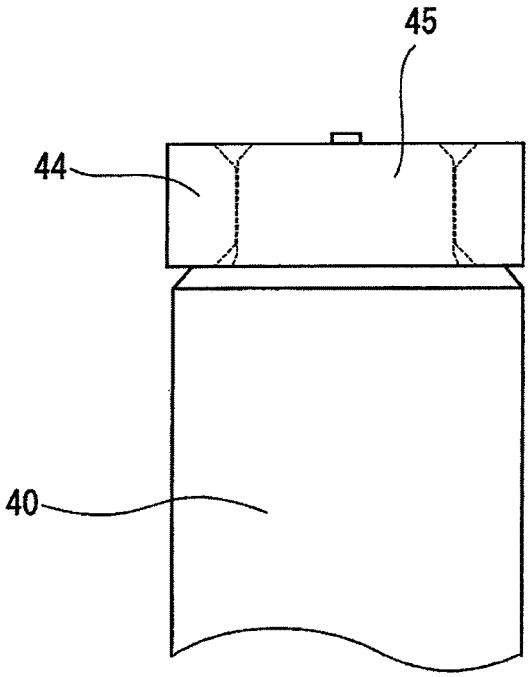
FIG. 9 is a partial cross-sectional view of a high-pressure pump according to a second embodiment of the present disclosure.

A second embodiment of the present disclosure is hereinafter described with reference to FIG. 9. According to the second embodiment, the plunger 40 and a large-diameter portion 44 are configured by different components.

A protrusion portion 45 having a cylindrical shape is formed at an end of the plunger 40 on the pressure chamber 15 side. The large-diameter portion 44 has an annular shape. A radial inner wall of the large-diameter portion 44 is press-fitted and fixed to a radial outer wall of the protrusion portion 45 of the plunger 40. A press-fit load of the large-diameter portion 44 is larger than urging force of the plunger spring 43.

The plunger 40 and the large-diameter portion 44 may be fixed to each other by screwing or welding, for example, rather than press-fit.

The plunger 40 and the large-diameter portion 44 are made of different materials. The linear expansion coefficient of the large-diameter portion 44 is larger than the linear expansion coefficient of the plunger 40. In other words, the large-diameter portion 44 is made of material more easily contractable by cooling than the material of the plunger 40.

For example, the plunger 40 is made of martensitic stainless steel. The linear expansion coefficient of martensitic stainless steel is approximately $10\times10^{-6}/°$ C.

On the other hand, the large-diameter portion 44 is made of austenitic stainless steel. The linear expansion coefficient of austenitic stainless steel is approximately $17\times10^{-6}/°$ C.

The materials of the plunger 40 and the large-diameter portion 44 are not limited to these examples, but may be selected from various other materials such as two-phase stainless steel.

According to the second embodiment, a relationship D1>D3>D2>D4 holds between the inside diameter D1 of the pressure chamber 15, the inside diameter D2 of the cylinder 10, the outside diameter D3 of the large-diameter portion 44, and the outside diameter D4 of the plunger 40 at normal temperature similarly to the first embodiment described above.

According to the second embodiment, however, the relationship between the inside diameter D1 of the pressure chamber 15, the inside diameter D2 of the cylinder 10, the outside diameter D3 of the large-diameter portion 44, and the outside diameter D4 of the plunger 40 switches to D1>D2>D3 D4 when any of following operations (D), (E), and (F) is performed. (D) The pump body 11 and the cylinder 10 are heated, while the large-diameter portion 44 is cooled. (E) The pump body 11 and the cylinder 10 are heated. (F) The large-diameter portion 44 is cooled.

Accordingly, insertion of the large-diameter portion 44 into the pressure chamber 15 is allowed from an opening of the cylinder 10 on the side opposite to the pressure chamber 15.

After any one of the operations (D), (E), and (F) is completed, the temperatures of the cylinder 10 and the large-diameter portion 44 are returned to the temperatures before the operation. As a result, the relationship between the inside diameter D1 of the pressure chamber 15, the inside diameter D2 of the cylinder 10, the outside diameter D3 of the large-diameter portion 44, and the outside diameter D4 of the plunger 40 becomes D1>D3>D2>D4. The large diameter portion 44 is therefore engaged with the step portion 36 connecting the cylinder 10 and the pressure chamber 15 in a state before attachment of the high-pressure pump 1 to the inner combustion engine. Accordingly, prevention of separation of the plunger 40 from the cylinder 10, and retention of a compressed state of the plunger spring 43 are both achievable.

A production method of the high-pressure pump 1 according to the second embodiment is substantially similar to the production method described in the first embodiment. However, in the temperature control process of S1 according to the second embodiment, both "heating the pump body 11 and the cylinder 10", and "cooling the large-diameter portion 44" are performed.

Note that the process performed in the temperature control process may be only either "heating the pump body 11 and the cylinder 10" or "cooling the large-diameter portion 44" as long as the foregoing relationship D1>D2>D3 D4 is realizable.

Following advantageous effects are offered in the second embodiment.

(1) According to the high-pressure pump 1 of the second embodiment, the plunger 40 and the large-diameter portion 44 are configured by different components.

When at least either "heating the pump body 11 and the cylinder 10" or "cooling the large-diameter portion 44" is performed, the cylinder 10 and the large-diameter portion 44 has a relationship such that the inside diameter D2 of the cylinder 10 becomes larger than the outside diameter D3 of the large-diameter portion 44.

In this case, cooling the large-diameter portion 44 is only needed at the time of insertion of the large-diameter portion 44 into the pressure chamber 15 without the necessity for cooling the plunger 40. Accordingly, energy necessary for cooling decreases.

(2) According to the high-pressure pump 1 of the second embodiment, the large-diameter portion 44 and the plunger 40 are made of different materials. The linear expansion coefficient of the large-diameter portion 44 is larger than the linear expansion coefficient of the plunger 40.

Accordingly, energy necessary for cooling the large-diameter portion 44 further decreases.

Third Embodiment

Figure 10:
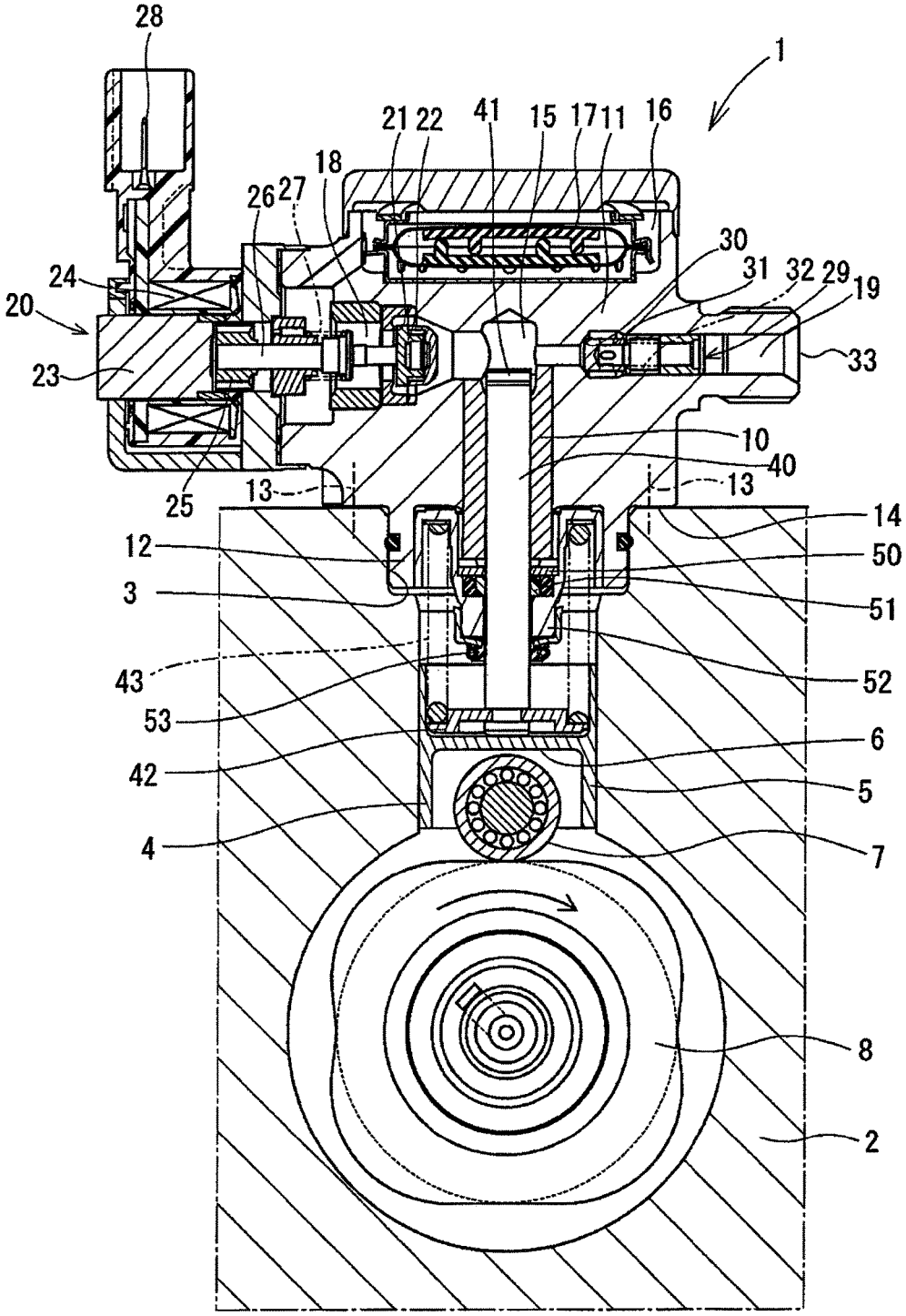
FIG. 10 is a cross-sectional view of a high-pressure pump according to a third embodiment of the present disclosure.

A third embodiment of the present disclosure is hereinafter described with reference to FIG. 10. According to the third embodiment, the cylinder 10 and the pump body 11 are configured by different components. On the other hand, the large-diameter portion 41 and the plunger 40 are formed integrally.

According to the third embodiment, a relationship D1>D3>D2>D4 holds between the inside diameter D1 of the pressure chamber 15, the inside diameter D2 of the cylinder 10, the outside diameter D3 of the large-diameter portion 41, and the outside diameter D4 of the plunger 40 at normal temperature similarly to the first and second embodiments described above.

According to the third embodiment, the relationship between the inside diameter D1 of the pressure chamber 15, the inside diameter D2 of the cylinder 10, the outside diameter D3 of the large-diameter portion 41, and the outside diameter D4 of the plunger 40 switches to D1>D2>D3>D4 when any of following operations (G), (H), and (I) is performed. (G) The cylinder 10 is heated, while the large-diameter portion 41 and the plunger 40 are cooled. (H) The cylinder 10 is heated. (I) The large-diameter portion 41 and the plunger 40 are cooled.

Accordingly, insertion of the large-diameter portion 41 into the pressure chamber 15 is allowed from an opening of the cylinder 10 on the side opposite to the pressure chamber 15.

After any one of the operations (G), (H), and (I) is completed, the temperatures of the cylinder 10 and the large-diameter portion 41 are returned to the temperatures before the operation. As a result, the relationship between the inside diameter D1 of the pressure chamber 15, the inside diameter D2 of the cylinder 10, the outside diameter D3 of the large-diameter portion 41, and the outside diameter D4 of the plunger 40 becomes D1>D3>D2>D4.

A production method of the high-pressure pump 1 according to the third embodiment is substantially similar to the production methods described in the first and second embodiments. However, in the temperature control process of S1 according to the third embodiment, both "heating the cylinder 10", and "cooling the large-diameter portion 41 and the plunger 40" are performed.

Note that the process performed in the temperature control process may be only either "heating the cylinder 10" or "cooling the large-diameter portion 41 and the plunger 40" as long as the foregoing relationship D1>D2>D3>D4 is realizable.

According to the high-pressure pump 1 of the third embodiment, the cylinder 10 and the pump body 11 are configured by different components.

In this case, heating the cylinder 10 is only needed at the time of insertion of the large-diameter portion 41 into the pressure chamber 15 without the necessity for heating the pump body 11. Accordingly, energy necessary for cooling decreases.

Fourth Embodiment

Figure 11:
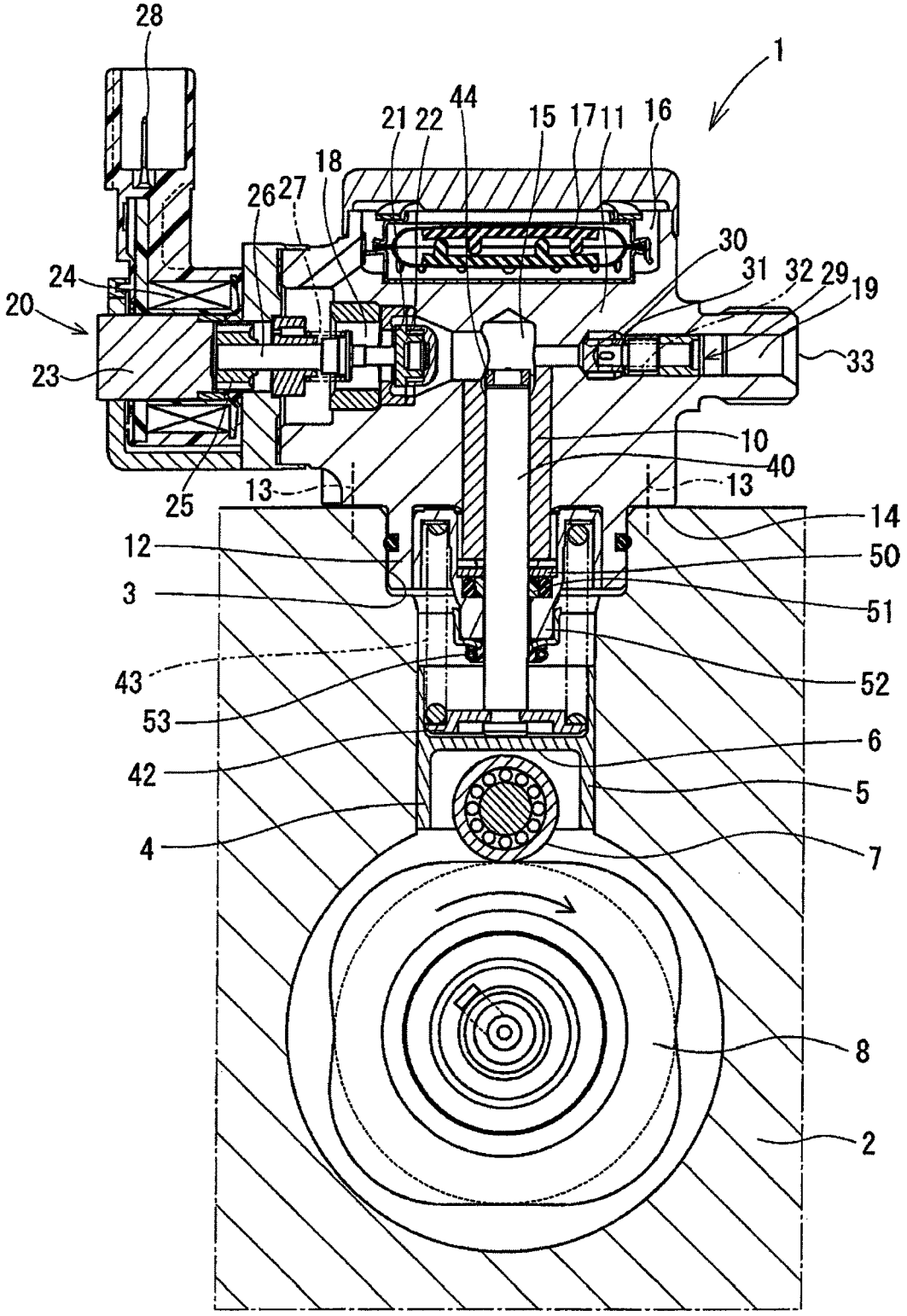
FIG. 11 is a cross-sectional view of a high-pressure pump according to a fourth embodiment of the present disclosure.

A fourth embodiment of the present disclosure is hereinafter described with reference to FIG. 11. According to the fourth embodiment, the cylinder 10 and the pump body 11 are configured by different components. Moreover, the large-diameter portion 44 and the plunger 40 are configured by different components.

According to the fourth embodiment, a relationship D1>D3>D2>D4 holds between the inside diameter D1 of the pressure chamber 15, the inside diameter D2 of the cylinder 10, the outside diameter D3 of the large-diameter portion 44, and the outside diameter D4 of the plunger 40 at normal temperature similarly to the first to third embodiments described above.

According to the fourth embodiment, the relationship between the inside diameter D1 of the pressure chamber 15, the inside diameter D2 of the cylinder 10, the outside diameter D3 of the large-diameter portion 44, and the outside diameter D4 of the plunger 40 switches to D1>D2>D3 D4 when any of following operations (J), (K), and (L) is performed. (J) The cylinder 10 is heated, while the large-diameter portion 44 is cooled. (K) The cylinder 10 is heated. (L) The large-diameter portion 44 is cooled.

Accordingly, insertion of the large-diameter portion 44 into the pressure chamber 15 is allowed from an opening of the cylinder 10 on the side opposite to the pressure chamber 15.

After any one of the operations (G), (H), and (I) is completed, the temperatures of the cylinder 10 and the large-diameter portion 44 are returned to the temperatures before the operation. As a result, the relationship between the inside diameter D1 of the pressure chamber 15, the inside diameter D2 of the cylinder 10, the outside diameter D3 of the large-diameter portion 44, and the outside diameter D4 of the plunger 40 becomes D1>D3>D2>D4.

A production method of the high-pressure pump 1 according to the fourth embodiment is substantially similar to the production methods described in the first to third embodiments. However, in the temperature control process of S1 according to the fourth embodiment, both "heating the cylinder 10", and "cooling the large-diameter portion 44" are performed. Note that the process performed in the temperature control process may be only either "heating the cylinder 10" or "cooling the large-diameter portion 44" as long as the foregoing relationship D1>D2>D3 D4 is realizable.

According to the high-pressure pump 1 of the fourth embodiment, the cylinder 10 and the pump body 11 are configured by different components. Moreover, the large-diameter portion 44 and the plunger 40 are configured by different components.

In this case, only temperature control of the cylinder 10 and the large-diameter portion 44 is needed at the time of insertion of the large-diameter portion 44 into the pressure chamber 15. Accordingly, energy necessary for temperature control decreases.

OTHER EMBODIMENTS (1) According to the high-pressure pump 1 described in the plurality of embodiments, the pressure chamber 15 on the side opposite to the plunger 40 is closed by the pump body 11. However, the suction valve unit 20, the discharge valve unit 29 or the like of the high-pressure pump 1 in another embodiment may be detachably attached to the pressure chamber 15 on the side opposite to the plunger 40.

Accordingly, the present disclosure is not limited to the embodiments described herein, but may be practiced in various other modes without departing from the scope of the invention, as well as combinations of the plurality of embodiments described herein.

The invention claimed is:

1. A high-pressure pump comprising:

a pump body including a cylinder and a pressure chamber, the pressure chamber having a larger inside diameter than an inside diameter of the cylinder, the pressure chamber being disposed at a deep end of the cylinder, the pump body closing the pressure chamber on a side opposite to the cylinder;

a plunger that reciprocates within the cylinder to vary a volume of the pressure chamber; and a large-diameter portion having an outside diameter larger than the inside diameter of the cylinder, and smaller than the inside diameter of the pressure chamber in a condition where the pump body and the plunger are at a normal temperature, the large-diameter portion being provided at an end of the plunger on a side protruding to the pressure chamber, wherein in a condition where a temperature of the pump body is higher than a temperature of the large-diameter portion, the inside diameter of the cylinder is larger than the outside diameter of the large-diameter portion.

2. The high-pressure pump according to claim 1, wherein:

a portion of the pump body forming the cylinder and the rest of the pump body are unitary.

3. The high-pressure pump according to claim 1, wherein:

the large-diameter portion and the plunger are unitary.

4. The high-pressure pump according to claim 1, wherein:

the large-diameter portion and the plunger are unitary;

a portion of the pump body forming the cylinder and the rest of the pump body are unitary.

5. The high-pressure pump according to claim 1, wherein:

the large-diameter portion and the plunger are made of different materials; and a linear expansion coefficient of the large-diameter portion is larger than a linear expansion coefficient of the plunger.

6. A production method for producing the high-pressure pump according to claim 1, the method comprising:

a temperature control process for performing at least either heating the cylinder or cooling the large-diameter portion to allow the inside diameter of the cylinder to become larger than the outside diameter of the large-diameter portion, or allow the outside diameter of the large-diameter portion to become smaller than the inside diameter of the cylinder;

an insertion process for inserting the plunger into the cylinder; and a normal temperature control process for allowing resultant temperatures of the cylinder and the large-diameter portion to approach temperatures of the cylinder and the large-diameter portion before the temperature control process.

7. The high-pressure pump according to claim 1, wherein:

in the condition where the temperature of the pump body is higher than the temperature of the large-diameter portion, the pump body allows insertion of the large-diameter portion into the pressure chamber from an opening of the cylinder on an side opposite to the pressure chamber.

8. The high-pressure pump according to claim 7, wherein: in the condition where the pump body and the plunger are at the normal temperature, the large diameter portion is engaged with a step portion of the pump body between the cylinder and the pressure chamber to avoid separation of the plunger from the cylinder.

9. The high-pressure pump according to claim 8, wherein: in the condition where the pump body and the plunger are at the normal temperature, the outside diameter of the large-diameter portion is larger than the inside diameter of the cylinder by a difference of several micrometers.

* * * * *